US012643194B2

(12) United States Patent
Ni et al.

(10) Patent No.: US 12,643,194 B2
(45) Date of Patent: Jun. 2, 2026

(54) SANDER

(71) Applicant: Nanjing Chervon Industry Co., Ltd., Nanjing (CN)

(72) Inventors: Muyang Ni, Nanjing (CN); Xiang Zhao, Nanjing (CN); Yasheng Chen, Nanjing (CN); Masatoshi Fukinuki, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 483 days.

(21) Appl. No.: 18/177,204

(22) Filed: Mar. 2, 2023

(65) Prior Publication Data

US 2023/0278163 A1 Sep. 7, 2023

(30) Foreign Application Priority Data

Mar. 7, 2022 (CN) ..... 202210225884.5
Dec. 8, 2022 (CN) ..... 202211573426.7

(51) Int. Cl.
*B24B 47/12* (2006.01)
*B24B 23/02* (2006.01)

(52) U.S. Cl.
CPC ..... *B24B 47/12* (2013.01); *B24B 23/02* (2013.01)

(58) Field of Classification Search
CPC ..... B24B 23/00; B24B 23/005; B24B 23/02; B24B 23/028; B24B 23/04; B24B 55/10; B24B 55/102; B24B 55/05; B24B 55/052; B24B 27/08; B24B 23/022; B24B 23/024; B24B 23/03; B24B 23/046; B24B 19/26; B24B 19/265; B24B 7/18; B24B 7/182; B24B 7/184; B24B 7/186; B24B 47/12; B24B 23/026
See application file for complete search history.

(56) References Cited

U.S. PATENT DOCUMENTS 5,020,281 A * 6/1991 Neff ..... B24B 41/04 451/344
6,758,731 B2 * 7/2004 Dutterer ..... B24B 55/102 451/357
2013/0165026 A1 * 6/2013 Sugita ..... B24B 23/04 451/357
2015/0083450 A1 * 3/2015 Sperl ..... B24B 23/03 173/217
2019/0232456 A1 * 8/2019 Sugita ..... B24B 47/12
2023/0256581 A1 * 8/2023 Mizutani ..... B25F 5/02 173/46

OTHER PUBLICATIONS

Mark Standard Handbook for Mechanical Engineers by Eugene A Avallone and Theodore Baumeister (Year: 1996).*

* cited by examiner

*Primary Examiner* — Brian D Keller
*Assistant Examiner* — John C Merino
(74) *Attorney, Agent, or Firm* — Greenberg Traurig, LLP

(57) ABSTRACT

A sander includes a housing, a baseplate assembly, an output shaft rotating about a first axis, an electric motor, and an electric motor shaft extending along a second axis. A first included angle formed between the first axis and the second axis is less than or equal to 60 degrees.

14 Claims, 18 Drawing Sheets

SANDER

CROSS-REFERENCE TO RELATED APPLICATION

This application claims priority to Chinese Patent Application No. 202210225884.5 Mar. 7, 2022, and Chinese Patent Application No. 202211573426.7 filed on Dec. 8, 2022, the disclosures of which are incorporated herein by reference in their entireties.

TECHNICAL FIELD

The present application relates to a power tool and, in particular, to a sander.

BACKGROUND

Sanders are power tools for polishing. Today, it has become a relatively common manner to provide energy input for a sander through a battery pack. However, the use of the battery pack causes some problems. For example, the weight of the battery pack and the manner in which the battery pack is mounted affect the center of gravity of the sander, affecting an operator's hand feel of holding the sander and vibration performance during operation. In addition, a space occupied by the battery pack has a certain effect on the size of the sander.

SUMMARY

The present application adopts the technical solutions described below. A sander includes a housing and a baseplate assembly. The housing forms an accommodation space and a grip for a user to hold. The baseplate assembly includes a baseplate. The sander further includes an output shaft and an electric motor. The output shaft drives the baseplate assembly to rotate and rotates about a first axis. The electric motor drives the output shaft to rotate and includes an electric motor shaft extending along a second axis. A first included angle formed between the first axis and the second axis is less than or equal to 60 degrees.

In an example, a retracted portion which gradually retracts is below the grip, and the electric motor is at least partially disposed above the retracted portion.

In an example, the output shaft is supported by a first bearing and a second bearing, and a bushing is disposed between the first bearing and the second bearing.

In an example, the electric motor and the output shaft are connected by a transmission shaft, and at least part of the transmission shaft is a bendable flexible portion.

In an example, a distance between the baseplate of the sander and a top of the housing is a first height, and the first height is less than or equal to 120 mm.

In an example, a distance between the first axis and a first surface of a battery pack coupling portion is a first distance, and the first distance is less than or equal to 49 mm.

In an example, when a battery pack is mounted to the sander, a distance between a top of the battery pack and a top of the housing is a second distance, and the second distance is less than or equal to 25 mm.

In an example, when a battery pack mates with a battery pack coupling portion of the sander, a projection of a center of gravity of the battery pack on a rear surface of the battery pack is in a first position; when the sander is not connected to the battery pack, a projection of a center of gravity of the sander on the rear surface of the battery pack is in a second position; and a first plane passing through the second axis is defined, the first plane is substantially perpendicular to the rear surface of the battery pack, and the first position and the second position are located on two sides of the first plane separately.

In an example, the sander includes a bearing support made of a metallic material.

In an example, the sander includes a maximum speed key, where the maximum speed key is operated so that a rotational speed of the baseplate assembly is adjusted directly to a maximum rotational speed.

In an example, the first included angle is greater than or equal to 5 degrees and less than or equal to 30 degrees.

The present application further provides a sander. The sander includes a housing and a baseplate assembly. The housing forms an accommodation space and a grip for a user to hold. The baseplate assembly includes a baseplate. The sander further includes an output shaft, an electric motor, and a transmission shaft. The output shaft drives the baseplate assembly to rotate and rotates about a first axis. The electric motor drives the output shaft to rotate and includes an electric motor shaft extending along a second axis. The transmission shaft connects the electric motor shaft to the output shaft, where at least part of the transmission shaft is a bendable flexible portion.

In an example, the transmission shaft transmits a rotational speed and torque outputted from the electric motor shaft to the output shaft.

In an example, a first end of the transmission shaft and the electric motor shaft rotate together through a first conversion member, and a second end of the transmission shaft and the output shaft rotate together through a second conversion member.

In an example, the transmission shaft is made of an iron-carbon alloy having a carbon content greater than or equal to 0.65% and less than or equal to 0.75%, where the carbon content refers to a mass fraction of carbon in the iron-carbon alloy.

In an example, hardness of the transmission shaft is greater than or equal to 35 HRC and less than or equal to 40 HRC, where a hardness unit HRC is Rockwell hardness.

The present application further provides a sander. The sander includes a housing and a baseplate assembly. The housing forms an accommodation space and a grip for a user to hold. The baseplate assembly includes a baseplate. The sander further includes an electric motor and a transmission assembly. The transmission assembly connects the electric motor to the baseplate assembly and drives the baseplate assembly to rotate, where at least part of the transmission assembly is a bendable flexible portion.

In an example, the transmission assembly includes: an electric motor shaft around which the electric motor rotates; an output shaft driving the baseplate assembly to rotate; and a transmission shaft connecting the electric motor shaft to the output shaft.

In an example, at least two of the electric motor shaft, the transmission shaft, and the output shaft are integrally formed.

DETAILED DESCRIPTION

To make solved technical problems, adopted technical solutions, and achieved technical effects of the present application clearer, the technical solutions in the examples of the present application are further described in detail below in conjunction with the drawings. The examples described below are part, not all, of the examples of the present application.

In the description of the present application, it is to be noted that orientations or position relations indicated by terms such as "center", "upper", "lower", "left", "right", "front", and "rear" are based on the drawings. These orientations or position relations are intended only to facilitate and simplify the description of the present application and not to indicate or imply that a device or element referred to must have such particular orientations or must be configured or operated in such particular orientations. Thus, these orientations or position relations are not to be construed as limiting the present application. Moreover, the terms such as "first" and "second" are used only for distinguishing between different structures or components and are not to be construed as indicating or implying relative importance.

Figure 1:
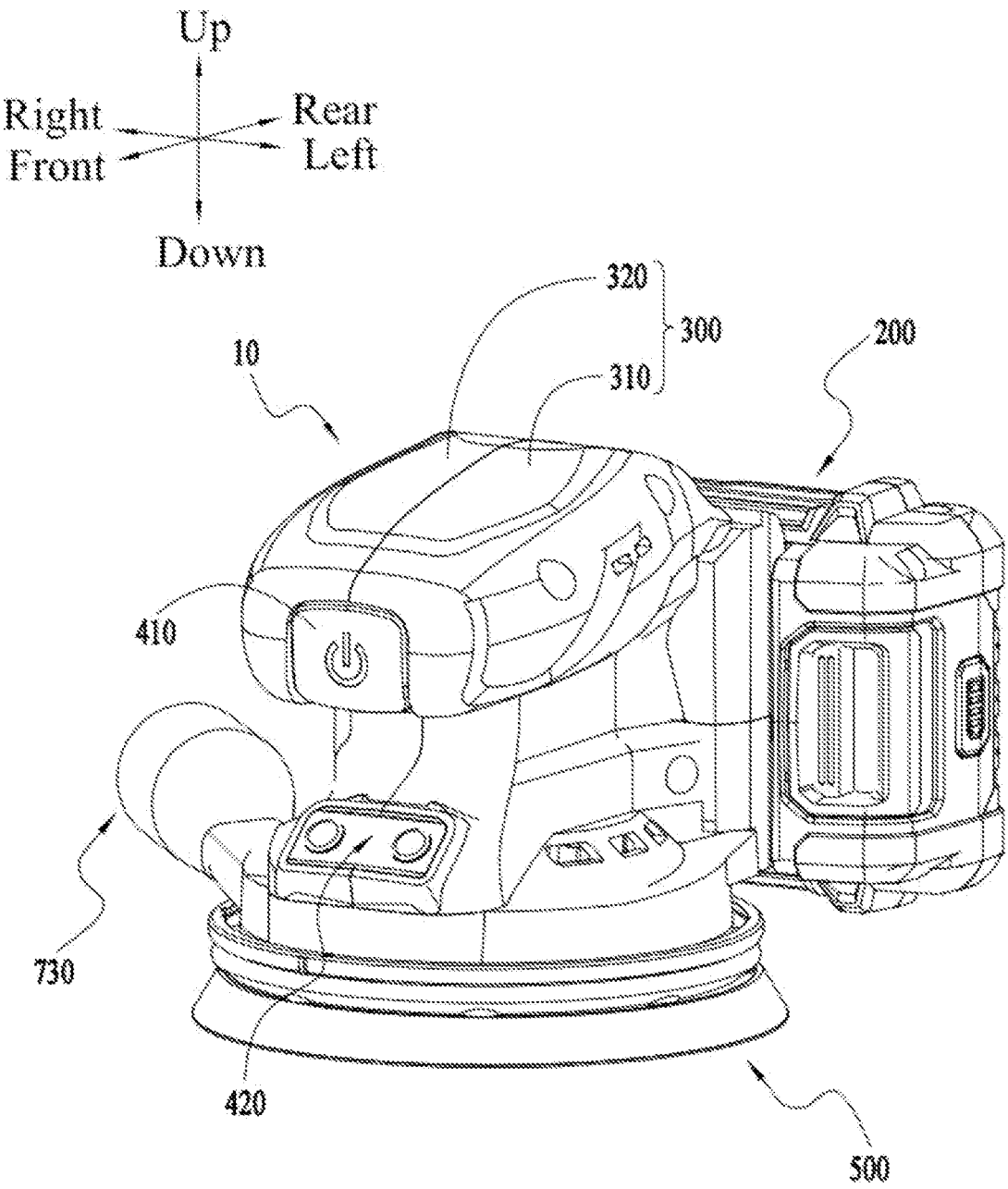
FIG. 1 is a perspective view of a sander with a battery pack mounted.

As shown in FIG. 1, a sander 10 includes a housing 300, a baseplate assembly 500, an output shaft 140, and a battery pack coupling portion 210. The sander 10 is connected to a battery pack 200 and finally drives, through energy supplied by the battery pack 200, the baseplate assembly 500 to perform eccentric rotation, thereby achieving a sanding effect.

In some examples, a power supply operation member 410 is used for controlling the start and stop of an electric motor 100. The power supply operation member 410 is disposed in the front of the housing 300 of the sander 10. In other words, the power supply operation member 410 is disposed in the front of a grip 330 of the sander 10. The sander 10 also includes a speed regulation switch 420 for adjusting a rotational speed of the baseplate assembly 500 in operation.

Figure 2:
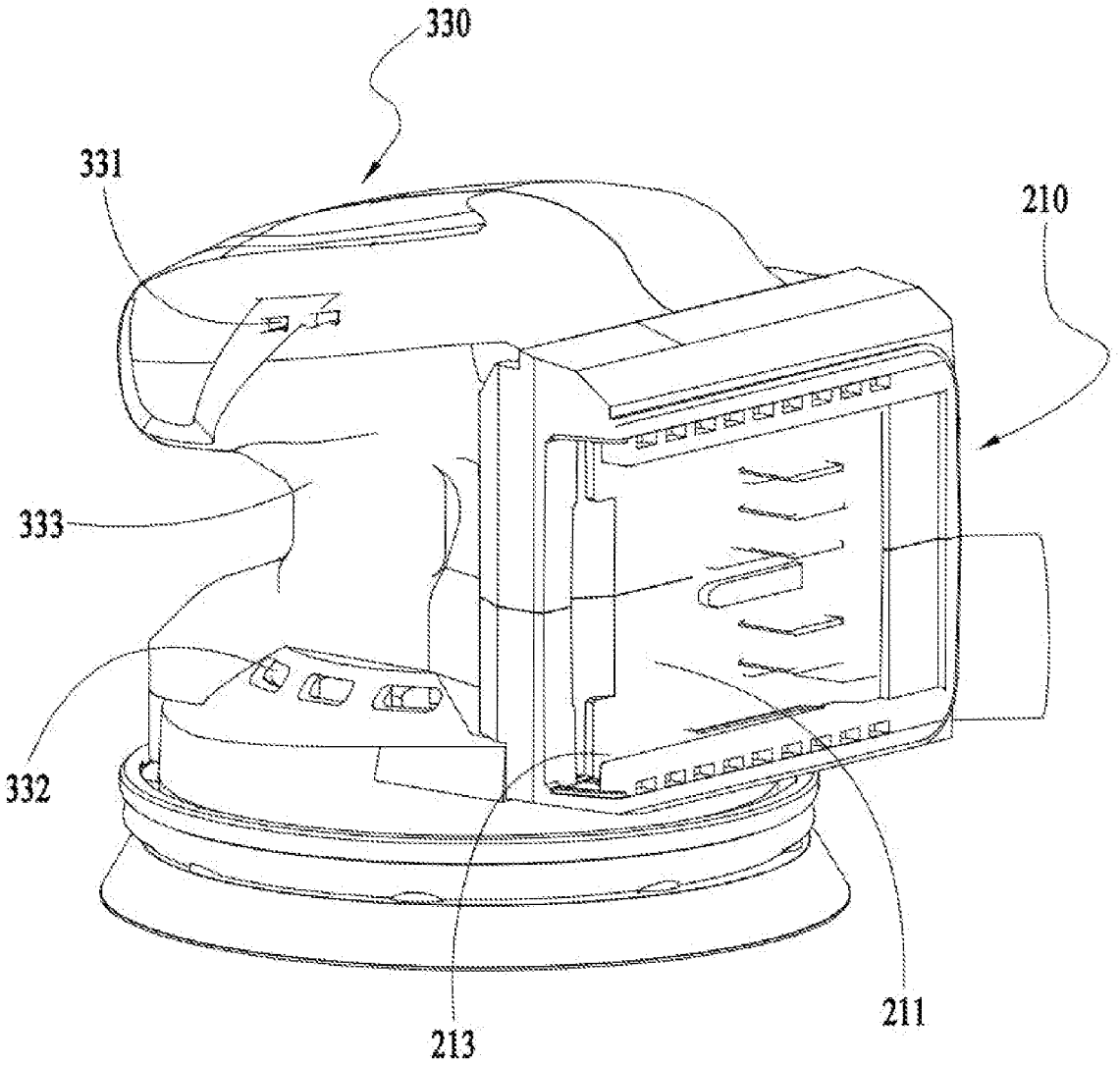
FIG. 2 is a perspective view of the sander in FIG. 1 with no battery pack mounted.
Figure 3:
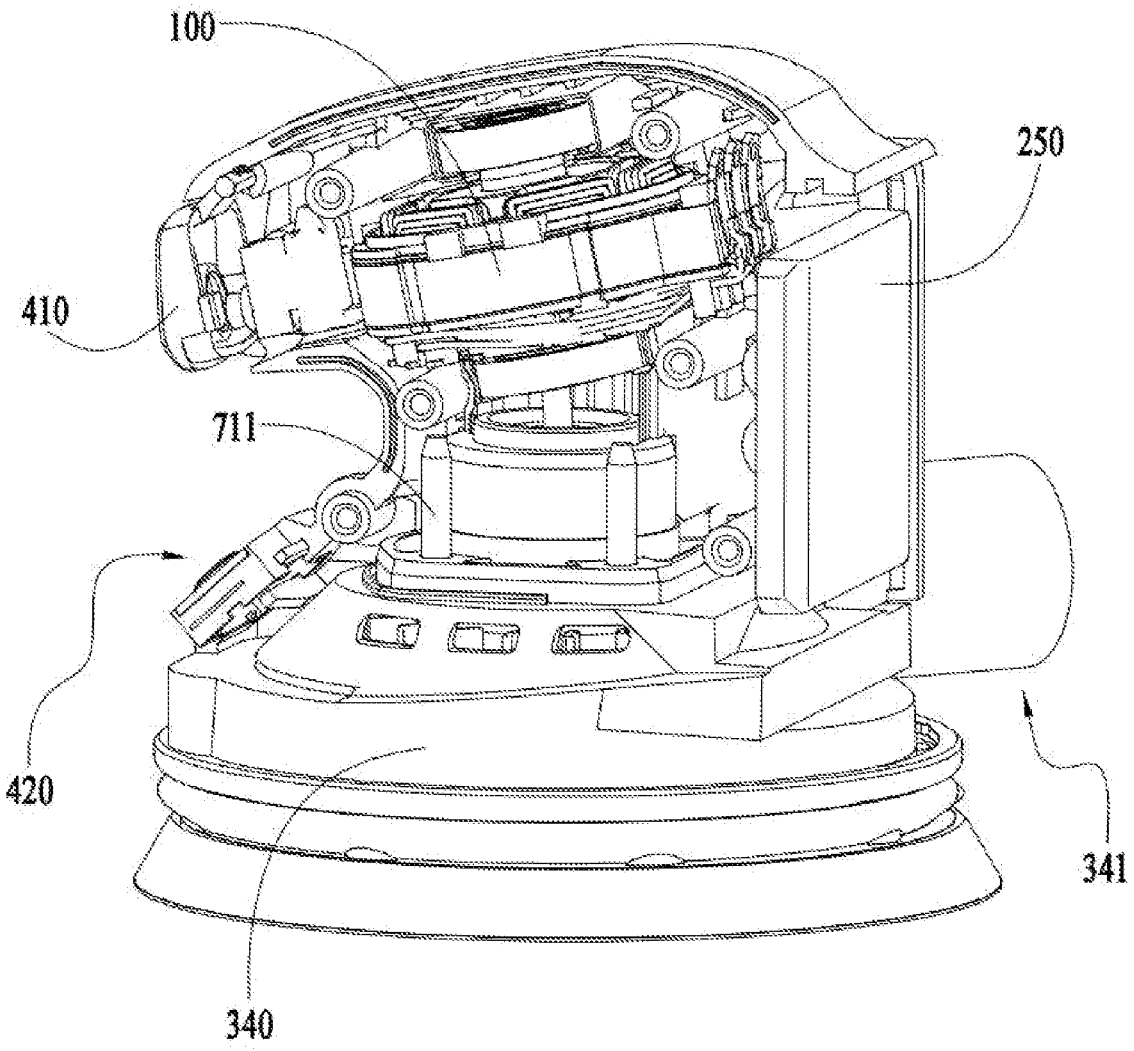
FIG. 3 is a perspective view of an internal structure of the sander in FIG. 1.

As shown in FIGS. 1 and 2, the housing 300 includes a first housing 310 and a second housing 320, and the grip 330 to be held is formed at an upper end of the housing 300. When operating the sander 10, an operator places a hand on the grip 330 at the top of the housing 300 to control a movement direction of the sander 10, or the operator may slightly press the sander 10 downward to apply appropriate pressure to the sander 10 to enhance a polishing effect. A surface of the grip 330 is curved so that the grip 330 may be held by a palm of the operator. In this example, the operator puts the center of the palm against a top end of the grip 330 and wraps fingers around the grip 330, but keeps away from the vicinity of the power supply operation member 410 so as not to trigger the power supply operation member 410 by mistake. As shown in FIG. 3, a retracted portion 333 which gradually retracts is below the grip 330, and the electric motor 100 is at least partially disposed above the retracted portion 333. In this example, most of the electric motor 100 is disposed above the retracted portion 333.

The battery pack coupling portion 210 is disposed on the sander 10 and mates with the battery pack 200 to complete the transmission of energy and signals. Sliding slots 213 are disposed on two sides of the battery pack coupling portion 210, and the battery pack 200 is slid into the battery pack coupling portion 210 through the sliding slots 213. The battery pack coupling portion 210 includes a first surface 211 which is in contact with the battery pack 200 or maintains a certain gap with the battery pack 200. Male terminals are disposed on the battery pack coupling portion 210 and inserted into female terminals on the battery pack 200. In some examples, specific configurations on the battery pack coupling portion 210 may be different from the configurations in this example.

Figure 4:
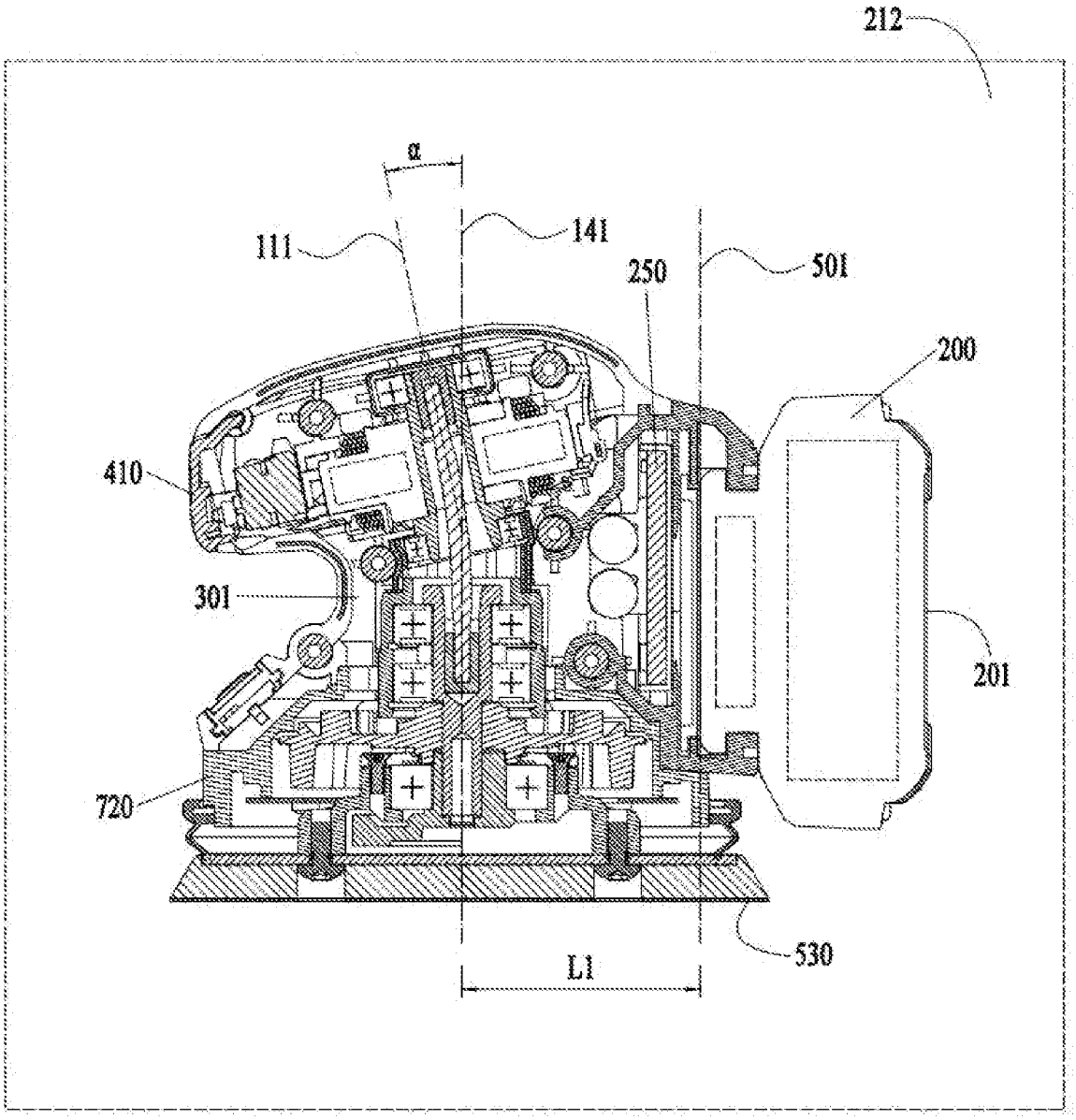
FIG. 4 is a sectional view of the sander in FIG. 1.

As shown in FIGS. 3 and 4, the housing 300 forms an accommodation space 301 where the electric motor 100 is accommodated. The electric motor 100 is driven through the energy supplied by the battery pack 200 to rotate, and the rotation of the electric motor 100 drives other transmission structures in the housing 300 to rotate, thereby driving the baseplate assembly 500 to perform the eccentric rotation. In this example, the electric motor 100 is an outrunner, where an external rotor of the electric motor 100 rotates around an electric motor shaft 110.

Figure 5:
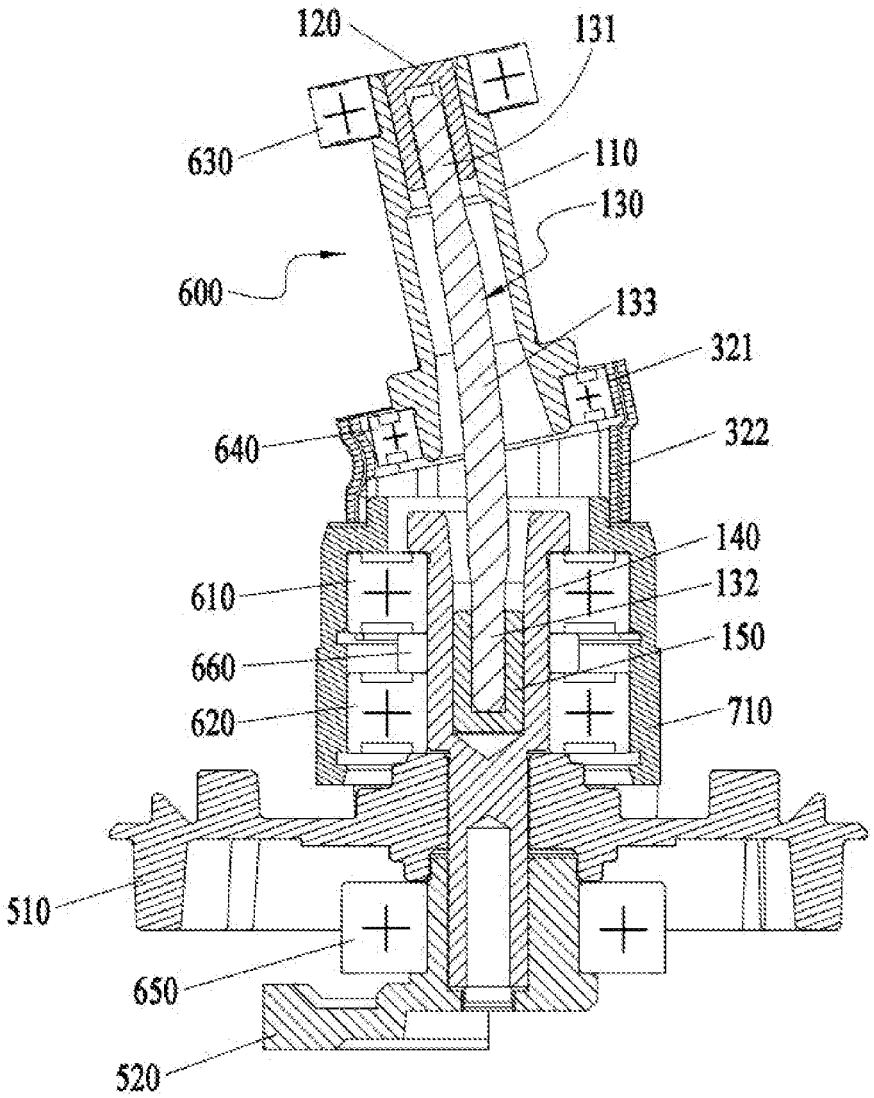
FIG. 5 is a partial enlarged view of the sectional view of the sander in FIG. 4.

As shown in FIGS. 4 and 5, the sander 10 includes the output shaft 140 which drives the baseplate assembly 500 to perform the eccentric rotation. The output shaft 140 rotates about a first axis 141, and the electric motor shaft 110 extends along a second axis 111, where a first included angle $\alpha$ formed between the first axis 141 and the second axis 111 is less than or equal to 60 degrees. In some examples, the first included angle $\alpha$ is less than or equal to 45 degrees. In some examples, the first included angle $\alpha$ is less than or equal to 30 degrees. In some examples, the first included angle $\alpha$ is greater than 5 degrees and less than 30 degrees. In the example shown in FIG. 4, the first included angle $\alpha$ is greater than 10 degrees and less than 15 degrees.

The sander 10 includes a transmission shaft 130 which connects the electric motor shaft 110 to the output shaft 140 and transmits a rotational speed and torque outputted from the electric motor shaft 110 to the output shaft 140. An end of the transmission shaft 130 connected to the electric motor 100 is a first end 131, and an end of the transmission shaft 130 connected to the output shaft 140 is a second end 132. During the rotation of the external rotor of the electric motor 100, the electric motor shaft 110 is also driven to rotate, the first end 131 of the transmission shaft 130 and the electric motor shaft 110 rotate together through a first conversion member 120, and the second end 132 of the transmission shaft 130 and the output shaft 140 rotate together through a second conversion member 150. Two ends of the transmission shaft 130 have specific shapes which mate with an opening of the first conversion member 120 and an opening of the second conversion member 150 separately so that the transmission shaft 130 rotates synchronously with the first conversion member 120 and the second conversion member 150. In addition, the first conversion member 120 and the second conversion member 150 are inserted into the electric motor shaft 110 and the output shaft 140, respectively, where the first conversion member 120 and the electric motor shaft 110 do not rotate relative to each other, and the second conversion member 150 and the output shaft 140 do not rotate relative to each other, either.

In this example, the transmission shaft 130 includes at least a bendable flexible portion 133. In some examples, the flexible portion 133 may be an iron-carbon alloy having a carbon content greater than or equal to 0.65% and less than or equal to 0.75%, where the carbon content refers to a mass fraction of carbon in the iron-carbon alloy. In some examples, hardness of the transmission shaft is greater than or equal to 35 HRC and less than or equal to 40 HRC, where a hardness unit HRC is Rockwell hardness.

In some examples, the transmission shaft 130 may include a coupling so that when the first axis 141 and the second axis 111 are at a certain angle, the rotational speed and the torque are transmitted.

The included angle between the first axis 141 of the output shaft 140 and the second axis 111 of the electric motor shaft 110 makes the electric motor 100 tilt forward, that is, the electric motor 100 tilts toward a direction away from the battery pack 200. In this example, a distance between a center of gravity of the electric motor 100 and the first axis 141 of the output shaft 140 is 3 mm. A certain space is left for a circuit board 250 and electronic elements on the circuit board 250 because of the tilt of the electric motor 100. In this example, the circuit board 250 is disposed between the electric motor 100 and the battery pack 200. The center of gravity of the electric motor 100 tilts forward, which improves the balance of the whole machine and is conducive to reducing vibration and improving holding experience.

In some examples, the electric motor 100 is configured to tilt backward, thereby leaving a larger space for the power supply operation member 410 at a front end.

As shown in FIG. 4, a surface of the battery pack 200 facing a rear side of the sander 10 is a rear surface 201 of the battery pack 200, a first plane 212 passing through the first axis 141 of the output shaft 140 is defined, and the first plane 212 is substantially perpendicular to the rear surface 201 of the battery pack 200. The first plane 212 divides the housing 300 of the sander 10 into two substantially symmetrical parts. In this example, the first plane 212 passes through the center of the power supply operation member 410 and "cuts" a housing assembly 300 substantially symmetrically along a joint between the first housing 310 and the second housing 320.

The first surface 211 of the battery pack coupling portion 210 intersects the first plane 212 to form a first intersection line 501, where a distance between the first axis 141 and the first intersection line 501 is a first distance L1. That is to say, a distance between the first axis 141 and the first surface 211 (referring to FIG. 2) of the battery pack coupling portion 210 is the first distance L1. In some examples, the first distance L1 is greater than 47 mm and less than or equal to 49 mm. In some examples, the first distance L1 is greater than or equal to 45 mm and less than or equal to 47 mm. In some examples, the first distance L1 is greater than or equal to 43 mm and less than 45 mm.

In this example, the second axis 111 of the electric motor 100 and the first axis 141 of the output shaft 140 are both outside the first plane 212. In some examples, the second axis 111 of the electric motor 100 is not entirely on the first plane 212, that is to say, the electric motor 100 may be deflected to the left or the right relative to the first plane 212.

As shown in FIG. 5, an upper half of the output shaft 140 is supported by a first bearing 610 and a second bearing 620, and a bushing 660 is disposed between the first bearing 610 and the second bearing 620. The top of the electric motor shaft 110 is supported by a third bearing 630, and the bottom of the electric motor shaft 110 is supported by a fourth bearing 640. A lower half of the output shaft 140 is connected to a balance block 520 supported by a fifth bearing 650. The first bearing 610 and the second bearing 620 are used in combination with the bushing 660 so that the output shaft 140 is more stable when swinging eccentrically, thereby increasing the service life of the bearing.

In some examples, the first bearing 610, the second bearing 620, and the bushing 660 are sealed in a bearing support 710, and a lower end of the electric motor shaft 110 and an upper end of the output shaft 140 are sealed by a first sealing rib 321 and a second sealing rib 322 on the housing 300. The sealing ribs are disposed on the housing 300 so that when the sander 10 is in operation, dust does not intrude into a movement space of the transmission shaft 130, thereby improving the service life of the transmission shaft 130. In practical application, the exterior of the transmission shaft 130 is typically installed in the electric motor shaft 110 after being soaked with grease, and the transmission shaft 130 is sealed by the sealing ribs on the housing 300.

The present application also discloses a sander. The sander includes a transmission assembly 600 connected to the electric motor 100 and the baseplate assembly 500, where the transmission assembly 600 drives the baseplate assembly 500 to rotate, and at least part of the transmission assembly 600 is the bendable flexible portion 133. In an example, the transmission assembly 600 includes the electric motor shaft 110, an output shaft 150, and the transmission shaft 130, where the electric motor 100 rotates around the electric motor shaft 110, the output shaft 150 drives the baseplate assembly 500 to rotate, and the transmission shaft 130 connects the electric motor shaft 110 to the output shaft 150. In an example, at least two of the electric motor shaft 110, the output shaft 150, and the transmission shaft 130 are integrally formed. That is to say, the electric motor shaft 110 and the transmission shaft 130 may be integrally formed, the output shaft 150 and the transmission shaft 130 may be integrally formed, or the electric motor shaft 110, the output shaft 150, and the transmission shaft 130 may be integrally formed.

Figure 6:
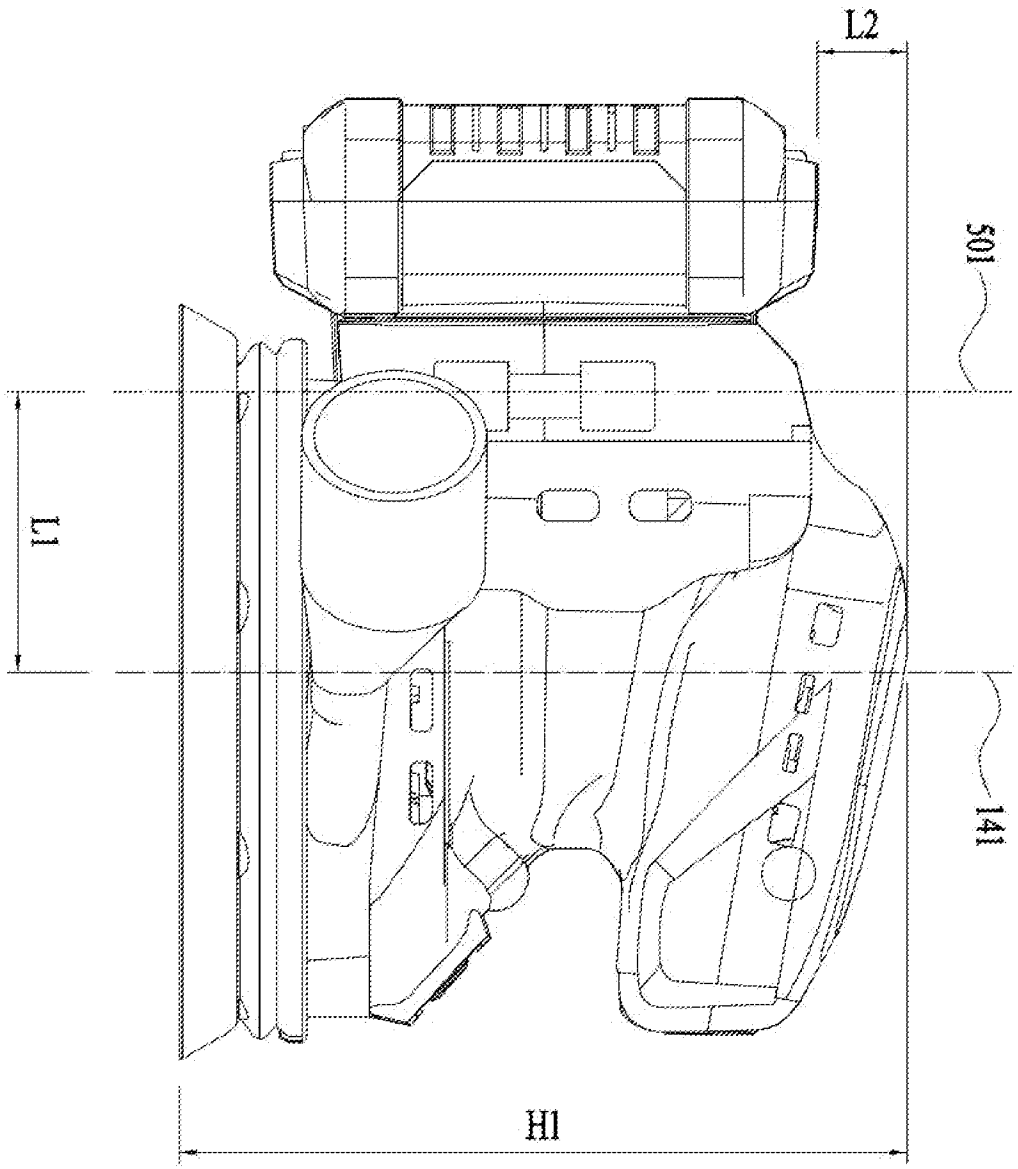
FIG. 6 is a side view of the sander in FIG. 1.

As shown in FIG. 6, a distance between a bottom of the baseplate assembly 500 of the sander 10 and the top of the housing 300 is a first height H1. In some examples, the first height H1 is less than or equal to 120 mm. In some examples, the first height H1 is less than or equal to 120 mm and greater than 115 mm. In some examples, the first height H1 is less than or equal to 115 mm and greater than 110 mm. In some examples, the first height H1 is less than or equal to 110 mm.

In some examples, when the battery pack 200 is transversely inserted into the sander 10, the top of the battery pack 200 is lower than or parallel to the top of the housing 300, and when the sander 10 adapts to different models of battery packs 200, the top of the battery pack 200 is generally not higher than the top of the housing 300. In this example, the battery pack 200 is inserted into the battery pack coupling portion 210 of the sander 10 along a direction parallel to the baseplate. In some examples, the battery pack 200 is inserted into the battery pack coupling portion 210 of the sander 10 from left to right. The battery pack 200 is inserted transversely so that the overall height of the sander 10 is limited and when the battery pack 200 is replaced, the overall height is not increased.

A distance between the top of the battery pack 200 and the top of the housing 300 is defined as a second distance L2. In some examples, the second distance L2 is less than or equal to 25 mm.

Figure 7:
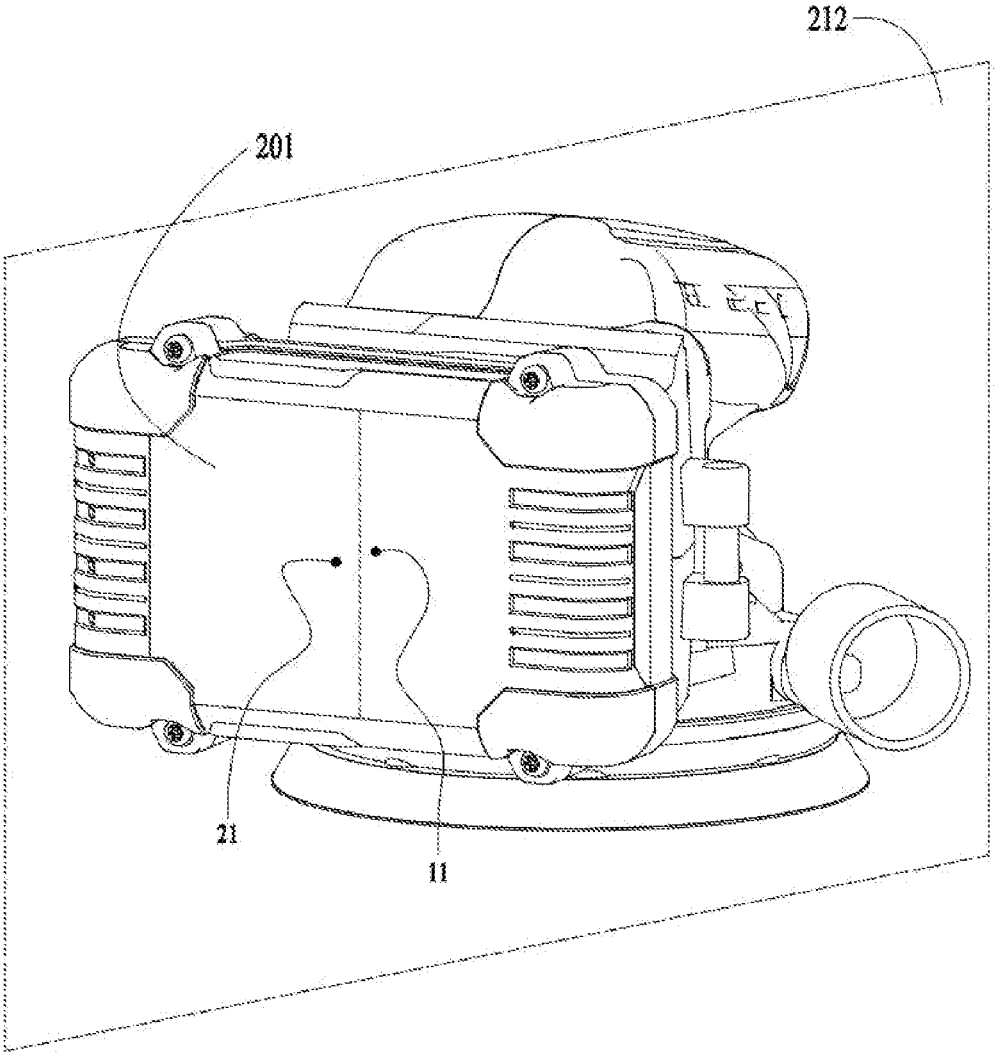
FIG. 7 is a perspective view of the sander in FIG. 1 from another angle of view.

As shown in FIG. 7, when the battery pack 200 mates with the battery pack coupling portion 210 of the sander 10, a projection of a center of gravity of the battery pack 200 on the rear surface 201 of the battery pack 200 is in a first position 21. When the sander 10 is not connected to the battery pack 200, a projection of a center of gravity of the sander 10 on the rear surface 201 of the battery pack 200 is in a second position 11. The first position 21 and the second position 11 are located on two sides of the first plane 212 separately.

With the preceding structure, the balance of the whole machine is effectively improved. In an example, a vibration value of the whole sander 10 is less than 3 $m/s^2$.

Figure 8:
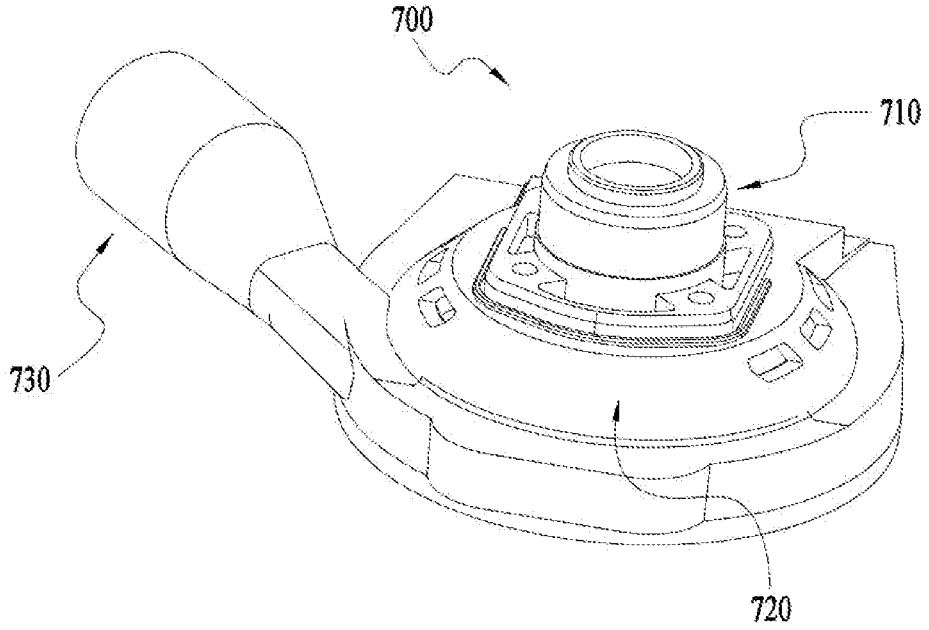
FIG. 8 is a perspective view of a dust collector.
Figure 9:
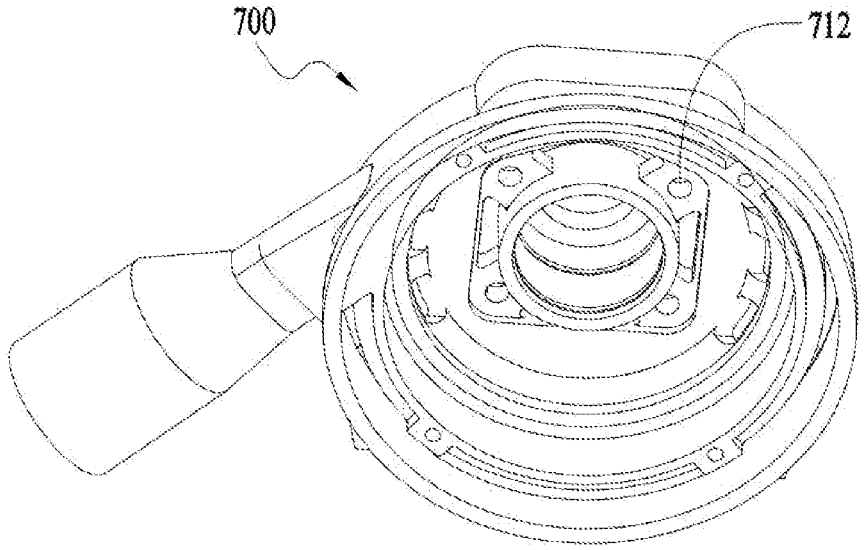
FIG. 9 is a perspective view of the dust collector in FIG. 8 from another angle of view.

As shown in FIGS. 8 and 9, the sander 10 further includes a dust collection tube 730 and a dust collection cover 720, where the dust collection cover 720 limits the movement of the dust in the sander 10, the dust collection tube 730 is used for connecting a dust collection bag, and a fan 510 blows the polished dust into the dust collection bag. In some examples, the bearing support 710, the dust collection cover 720, and the dust collection tube 730 are integrally formed into a dust collector 700. In some examples, the bearing support 710, the dust collection cover 720, and the dust collection tube 730 are separately formed and then assembled together. In some examples, screws 711 (referring to FIG. 3) pass through first mounting holes 712 on the bearing support 710 so that the bearing support 710 and the dust collection cover 720 are fixed.

Figure 10:
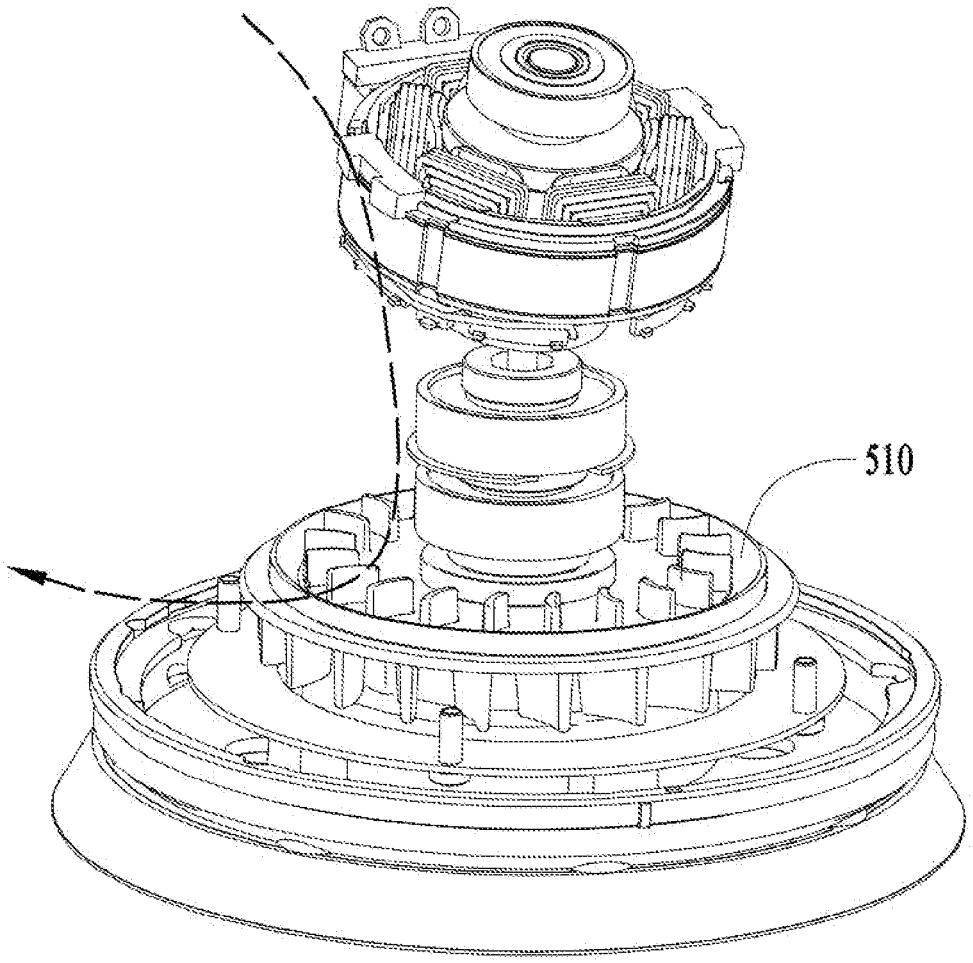
FIG. 10 is a schematic view showing an air path of the sander in FIG. 1.

FIG. 10 discloses a heat dissipation air path of the sander 10. In conjunction with FIG. 2, an air inlet 331 and an air outlet 332 are disposed on the sander 10. In this example, the air inlet 331 includes at least two openings substantially flush with each other, and the air outlet 332 also includes at least two openings substantially flush with each other. In some examples, the air inlet 331 is disposed on the housing 300 and along the periphery of the grip 330, and the air outlet 332 is disposed on the dust collection cover 720 and outside the fan 510. A negative pressure is generated through the rotation of the fan 510 so that air outside the sander 10 enters the sander 10 through the air inlet 331, flows downward along the electric motor 100, flows through the bearing support 710, and finally flows out of the sander 10 through the air outlet 332. A flow sequentially takes away heat generated by the electric motor 100 and the bearing support 710 during a flowing process.

In some examples, the bearing support 710 is made of a metallic material. In some examples, the bearing support 710 is made of an aluminum alloy material. In some examples, the dust collector 700 is made of the metallic material. The bearing support 710 made of aluminum is more reliable in fixing the bearing, and heat generated when the bearing moves can be transmitted to the bearing support 710 made of aluminum and the dust collection cover 720 to be dissipated in time. Static electricity generated by the dust is also reduced in the dust collection cover 720 made of the metallic material. In some examples, the bearing support 710 is made of a zinc alloy material. In some examples, the dust collection tube 730 may be made of a plastic material and then assembled with the dust collection cover 720 and the bearing support 710 made of the metallic material for use.

Figure 11:
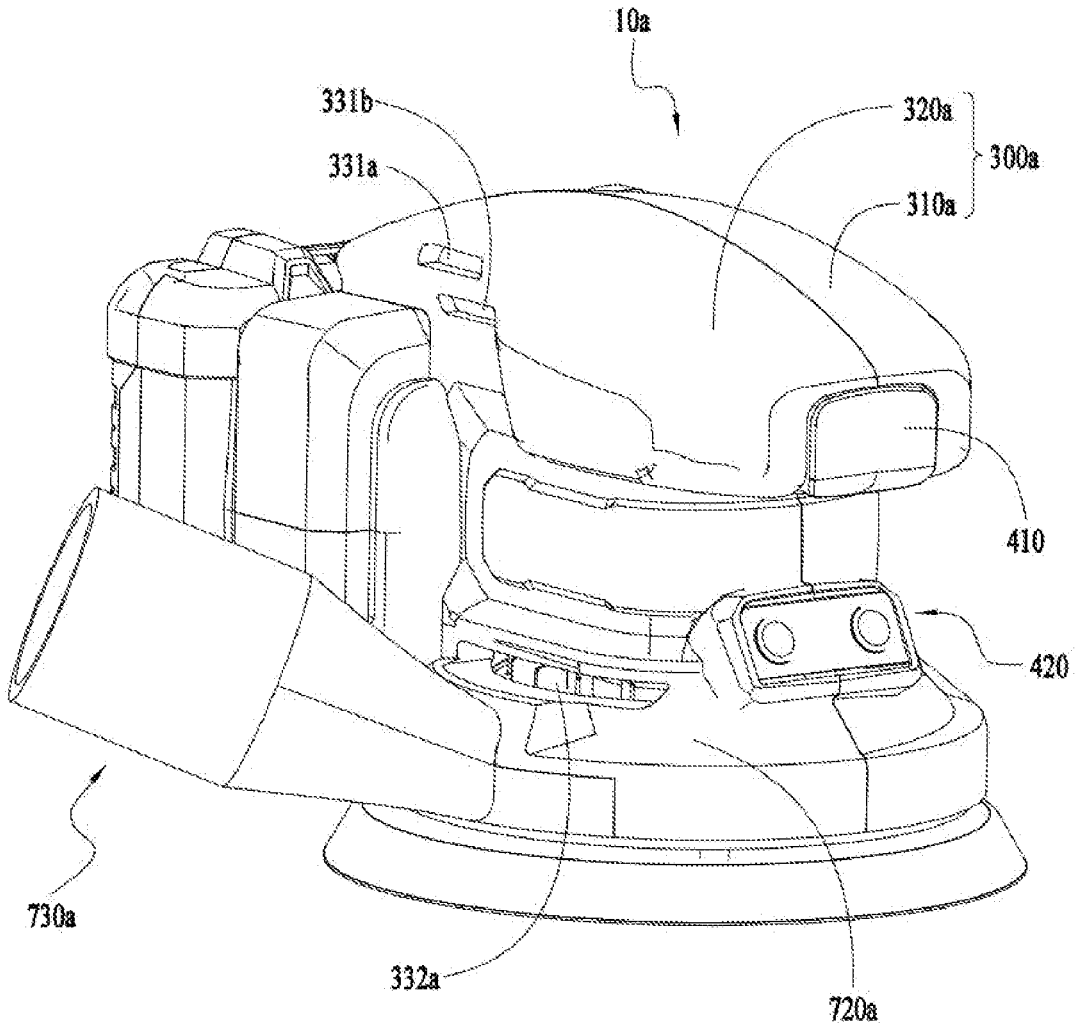
FIG. 11 is a perspective view of a sander in another example with a battery pack mounted.
Figure 12:
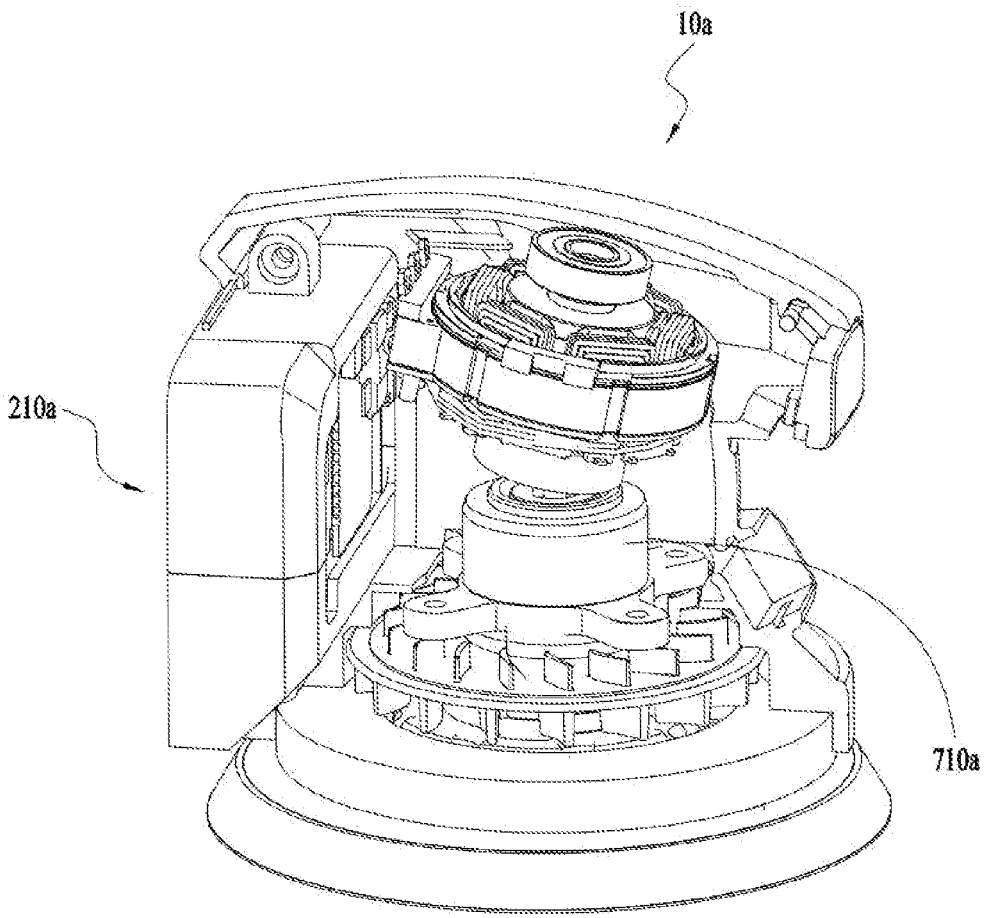
FIG. 12 is a perspective view of an internal structure of the sander in FIG. 11.
Figure 13:
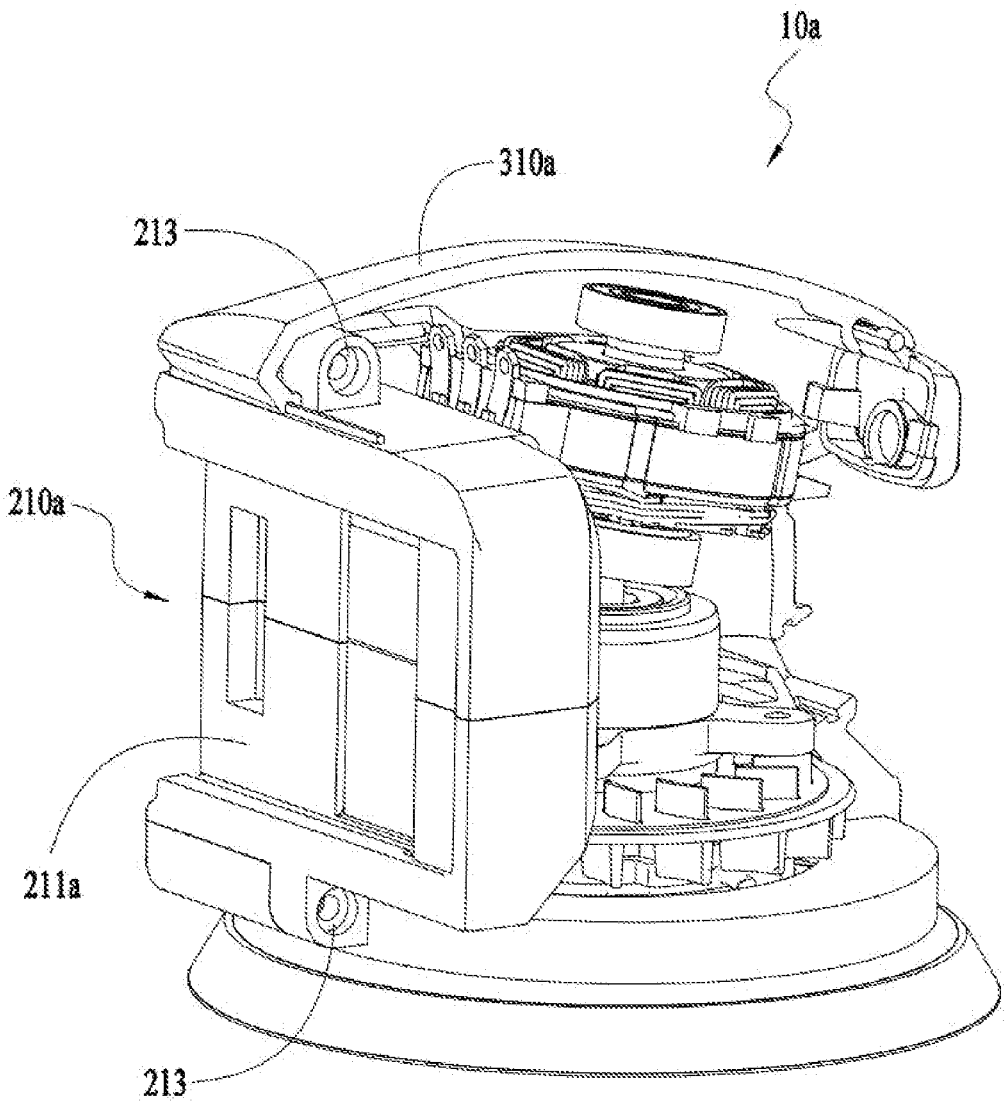
FIG. 13 is a perspective view of the sander in FIG. 12 from another angle of view.

A sander 10*a* disclosed in FIGS. 11 to 13 is another example of the sander. A dust collection cover 720*a* is a part of a first housing 310*a* and a second housing 320*a* of the sander 10*a*, and lower ends of the first housing 310*a* and the second housing 320*a* combined together form the dust collection cover 720*a*. In some examples, a housing 300*a*, the dust collection cover 720*a*, and a dust collection tube 730*a* are all made of plastic.

As shown in FIG. 11, an air inlet 331*a* and an air inlet 331*b* are arranged substantially from up to down so that air enters the sander 10*a* from as high a position as possible. In this example, an air outlet 332*a* is in the shape of an elongated slot, and a large area of the air outlet 332*a* facilitates the rapid discharge of hot air.

As shown in FIGS. 12 and 13, a bearing support 710*a* is fixed on the housing 300*a* by screws. A battery pack coupling portion 210*a* is connected to the first housing 310*a* through second mounting holes 213. A first surface 211*a* of the battery pack coupling portion 210*a* is substantially in contact with the battery pack 200.

Figure 14:
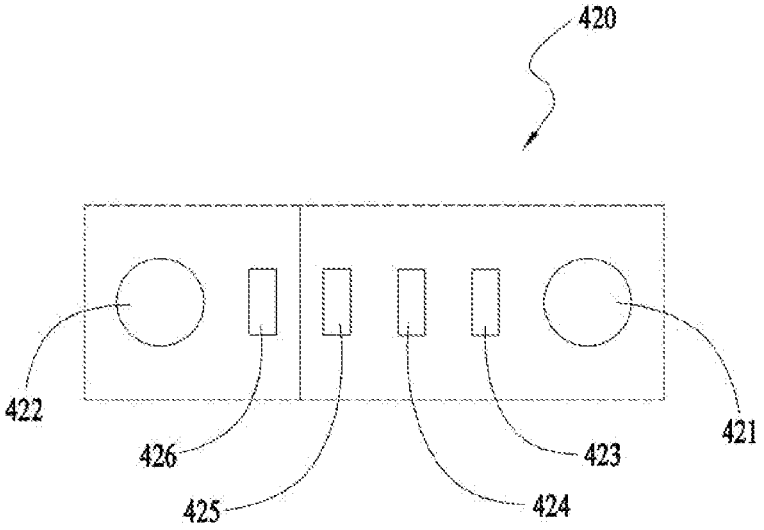
FIG. 14 is a schematic view of a speed regulation switch of the sander in FIG. 1.

FIG. 14 discloses an example of the speed regulation switch 420. An acceleration key 421 is adjusted so that a rotational speed of the sander 10 is adjustable from low to high among a first rotational speed, a second rotational speed, a third rotational speed, and a fourth rotational speed. When the sander 10 is in different gears of rotational speeds, a first rotational speed light 423, a second rotational speed light 424, a third rotational speed light 425, and a fourth rotational speed light 426 are turned on separately. When the acceleration key 421 is operated once, the rotational speed is increased by one gear; and when the rotational speed is increased to the fourth rotational speed, if the acceleration key 421 is operated again, the rotational speed is adjusted back to the first rotational speed. In this example, the speed regulation switch 420 is provided with a maximum speed key 422. The maximum speed key 422 is operated so that the rotational speed of the baseplate assembly 500 of the sander 10 is directly increased to a maximum rotational speed, that is, the fourth rotational speed, and the fourth rotational speed light 426 is turned on at this time. The maximum speed key 422 is disposed so that the rotational speed of the sander 10 is adjusted rapidly, thereby meeting requirements of various working conditions.

FIGS. 15 to 18 show another example of a sander 10*b*.

Figure 15:
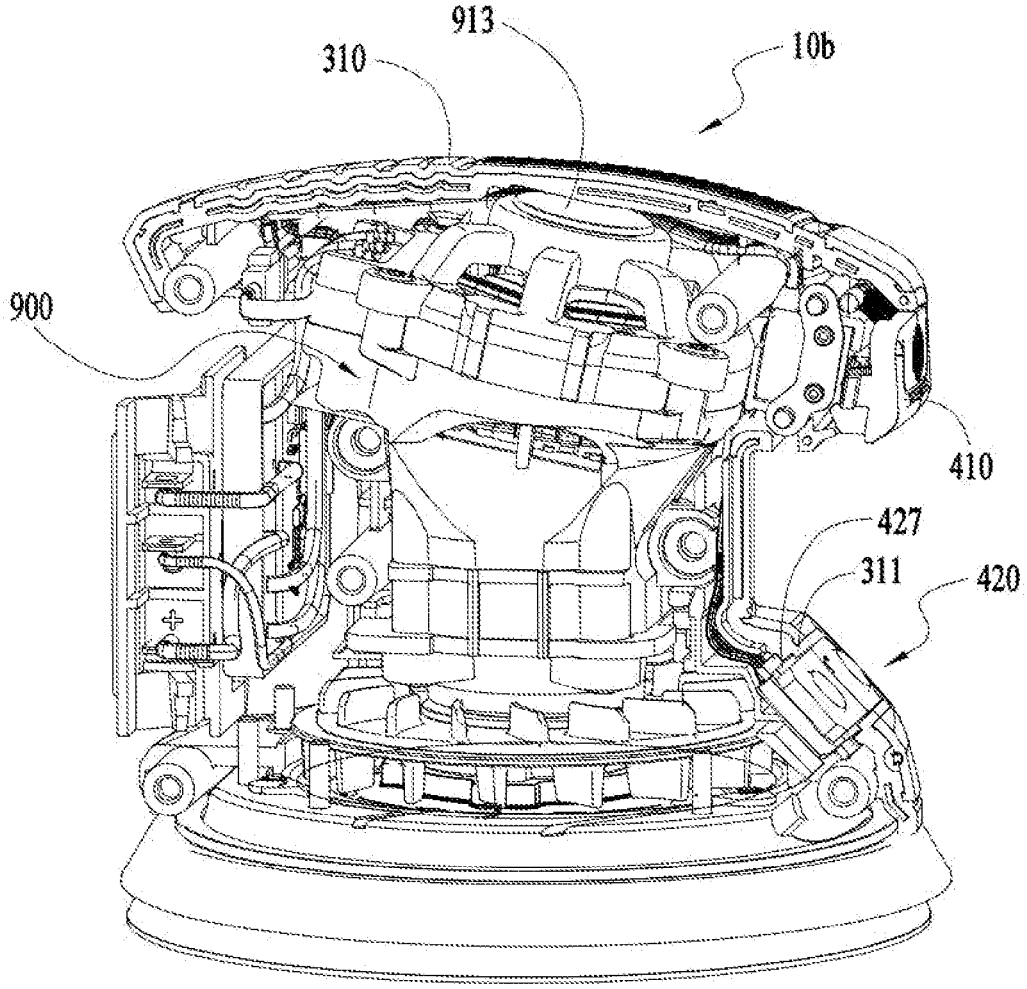
FIG. 15 is a perspective view of an example of another sander of the present application.
Figure 16:
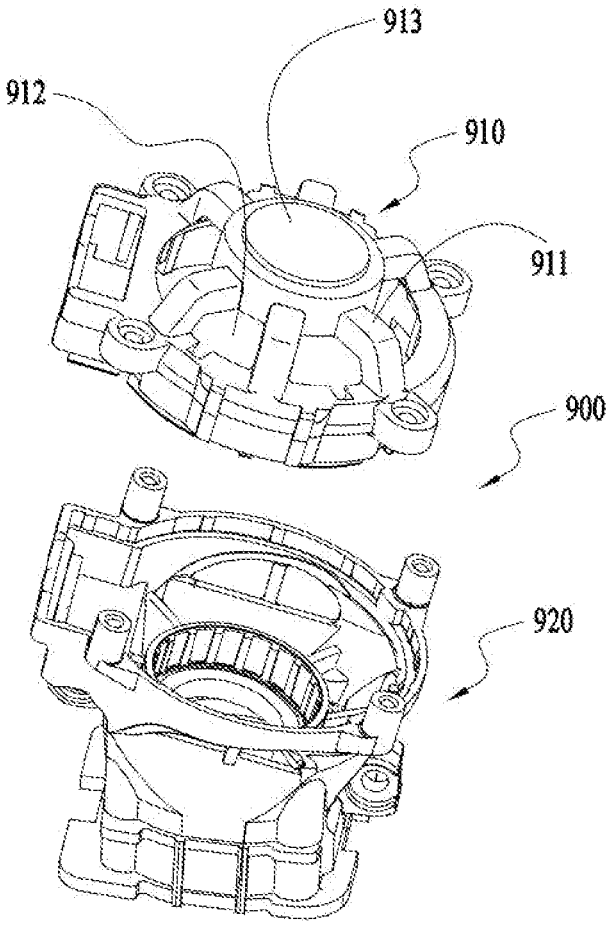
FIG. 16 is a perspective view of a transmission case in FIG. 15.

As shown in FIGS. 15 and 16, the sander 10*b* includes a transmission case 900 in which at least transmission structures such as the electric motor 100 and the output shaft 140 are accommodated. In this example, the transmission case 900 is constituted by an upper part and a lower part which are an upper transmission case 910 and a lower transmission case 920, respectively. The upper transmission case 910 and the lower transmission case 920 are fixed by screws. Compared with the sander 10 disclosed in FIG. 3 where the electric motor 100 and the output shaft 140 in the sander 10 are limited by ribs formed by the housing 300, the electric motor 100 and the output shaft 140 in the sander 10*b* shown in FIG. 15 are limited by the transmission case 900 disposed additionally. The advantage is that the transmission case 900 is not in contact with the housing 300 so that the heat generated by the electric motor 100 and the output shaft 140 is prevented from being transmitted to the housing 300 and thus, the temperature of the grip 330 is prevented from being too high to affect the holding experience of the operator.

As shown in FIG. 16, an upper end portion 913 is disposed at the top of the upper transmission case 910 of the sander 10*b*, and a gap exists between the upper end portion 913 and the first housing 310. The upper end portion 913 is supported by multiple support portions 911. One heat dissipation gap 912 is formed between every two support portions 911. Therefore, each upper transmission case 910 has multiple heat dissipation gaps 912. The output shaft 140 is substantially disposed in the lower transmission case 920.

FIG. 15 also shows a manner in which the speed regulation switch 420 is mounted. The speed regulation switch 420 has a protruding edge 427 which is limited by a first limiting portion 311 on the housing 300. Compared with a common manner in which the panel of the speed regulation switch 420 is directly stuck on the housing 300, the structure disclosed in FIG. 15 can effectively prevent the panel of the speed regulation switch 420 from loosening and dropping.

Figure 17:
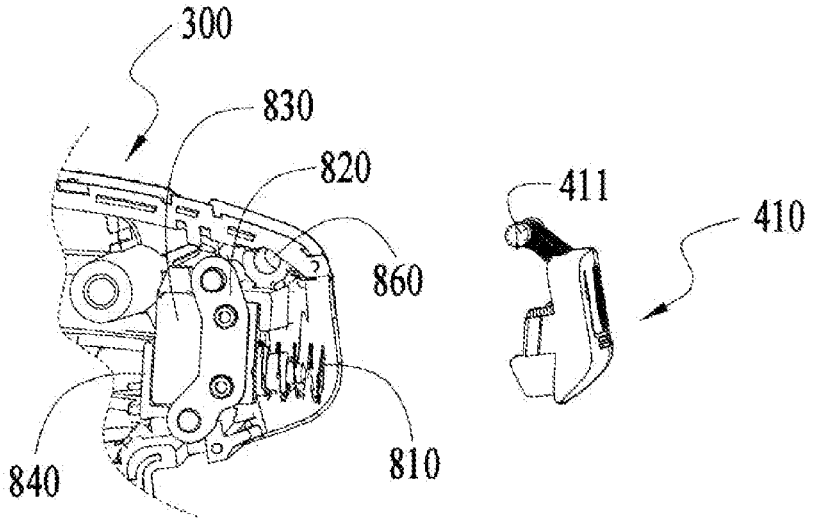
FIG. 17 is a perspective view of a power supply operation member and a switch box in FIG. 15.
Figure 18:
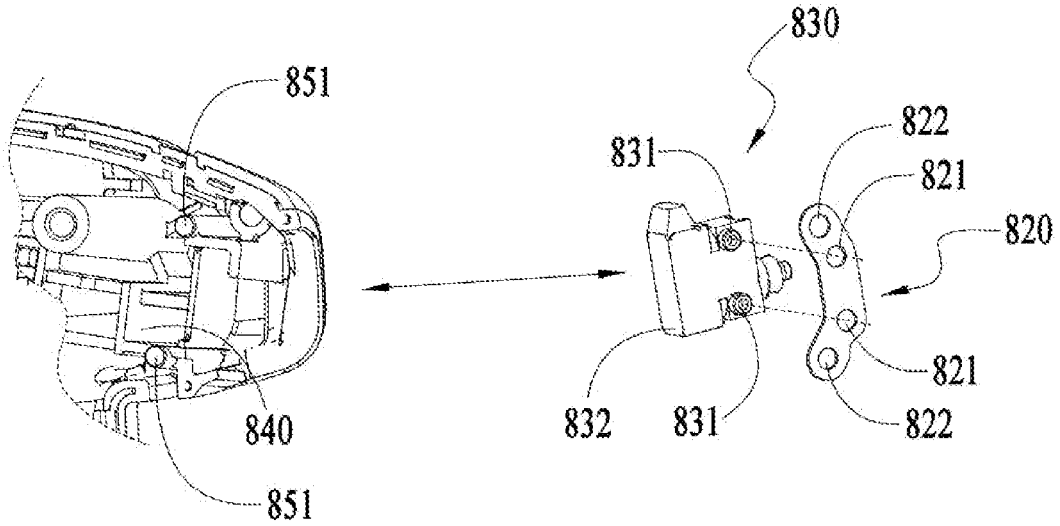
FIG. 18 is an exploded view of a structure in FIG. 17.

FIGS. 17 and 18 show the power supply operation member 410 and a driving manner thereof. As shown in FIG. 17, the power supply operation member 410 has a pivot shaft 411 disposed in a second limiting portion 860 of the housing 300. In this example, the second limiting portion 860 is a circular slot. When a user presses the power supply operation member 410, a spring 810 is compressed and a switch box 830 is triggered.

In this example, a fixing plate 820 is used for reinforcing the fixing between the switch box 830 and the housing 300. As shown in FIG. 18, the fixing plate 820 has two first holes 821 and two second holes 822, where the two first holes 821 are sleeved on two first protrusions 831 of the switch box 830, and the two second holes 822 are sleeved on two columns 851 of the housing 300. A limiting rib 840 is disposed on the housing 300, and the switch box 830 has a corner 832, where the corner 832 is defined by the limiting rib 840 and is in direct contact with the limiting rib 840. The sander in operation vibrates, and the corner 832 and the limiting rib 840 are in a state of colliding with each other. When the corner of the switch box 830 is damaged by the limiting rib 840, the switch box 830 fails. Therefore, the fixing plate 820 shares the damage caused by the vibration of the sander to the switch box 830, prolonging the service life of the switch box 830.

Figure 19:
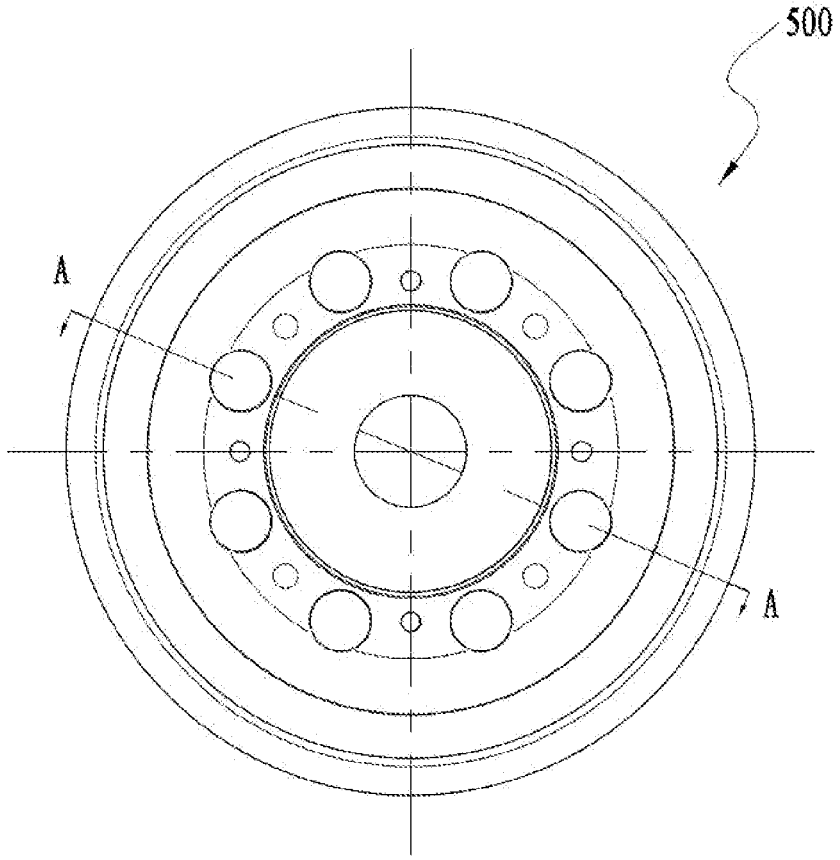
FIG. 19 is a bottom view of the baseplate assembly.
Figure 20:
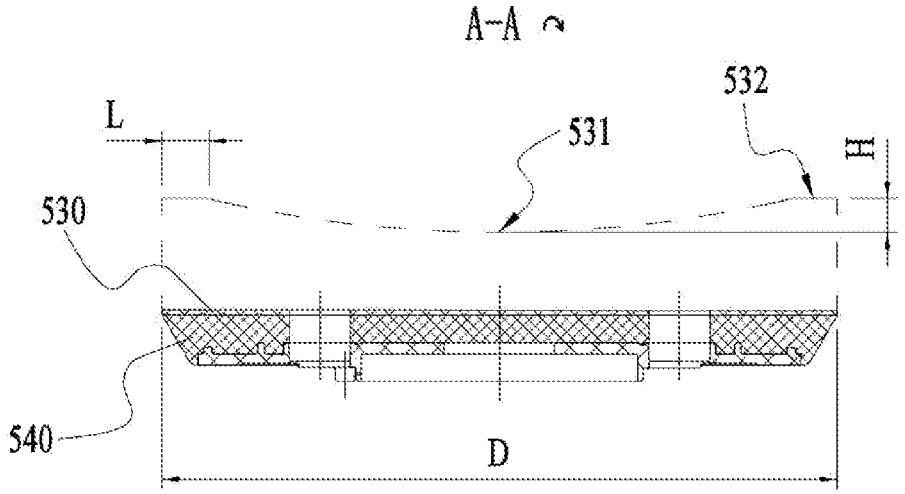
FIG. 20 is a section view of the baseplate assembly in FIG. 19.

As shown in FIG. 19 and FIG. 20, the baseplate assembly 500 includes a sandpaper receiver 530 and a baseplate board 540. The sandpaper receiver 530 is used for attaching a sandpaper for sanding or polishing. The baseplate board 540 is used for supporting the sandpaper receiver 530 through the sanding process.

Figure 21:
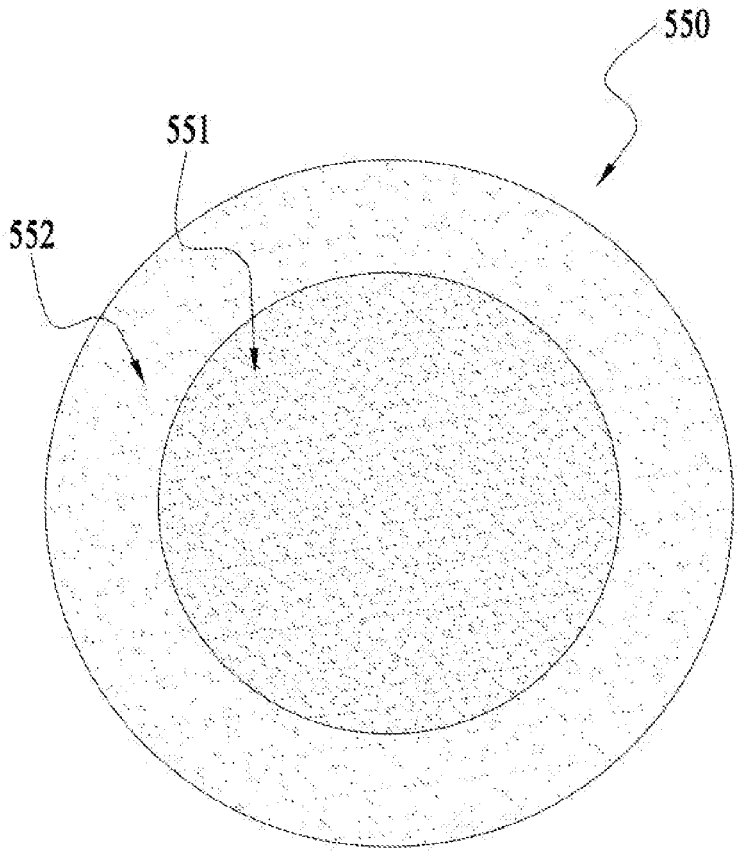
FIG. 21 is a schematic diagram of a sanding area sanded by the sander.

FIG. 21 is a schematic diagram of a sanding area 550 sanded by the sander 10. Normally, the sanding area 550 turns out to be uneven, which means not all the sanding area have the same sanding effect. The sanding area 550 includes a first sanding area 551 and a second sanding area 552. The first sanding area 551 is closer to a center of the sandpaper. The second sanding area 552 is at an outer ring of the sandpaper. Thus, the second sanding area 552 surrounds the first sanding area 551. The reason why the sanding area 550 appears to be similar to FIG. 21 is a pressing force passed from a hand holding the sander 10. Since the pushing hand concentrates more around the center of the baseplate assembly 500, the first sanding area 551 is always sanded more than the second sanding area 552.

Then turn back to FIG. 19 and FIG. 20. FIG. 19 is a bottom view of the baseplate assembly 500. FIG. 20 is a section view of section A-A in FIG. 19. The dotted line in FIG. 20 is an exaggerated line to show a bottom surface of the baseplate assembly 500.

To improve the uneven sanding circles shown in FIG. 21, the baseplate assembly 500 is manufactured to be with a sunk area 531. Outside the sunk area 531 surrounds a flat area 532. A height difference H between a lowest point of the sunk area 531 and the highest point of the sunk area 531 is smaller than or equal to 0.6 mm. In one example, a diameter D of the sandpaper receiver 530 is about 125 mm, and a radial distance L between two edges of the flat area 532 is bigger than or equal to 6 mm and smaller than or equal to 20 mm. In some examples, the radial distance L could be 8.5 mm, 10 mm or 15 mm. In other words, a ratio of the radial distance L to the diameter D is greater than 0.048 and smaller than 0.16.

With this kind of design, when user hold the sander 10 and press the sander 10 to sand a surface, the pressing force leads to a shape change of the bottom surface of the baseplate assembly 500 and makes the sunk area 531 almost even. In this way, the sanding surface comes out to be more even in a radial direction. To machine the baseplate assembly 500 in this application, the sandpaper receiver 530 and the baseplate board 540 could be integrally formed by a mould with a same shape.

The basic principles, main features, and advantages of the present application are shown and described above. It is to be understood by those skilled in the art that the preceding examples do not limit the present application in any form, and all technical solutions obtained by means of equivalent substitutions or equivalent transformations fall within the scope of the present application.

What is claimed is:

1. A sander, comprising:

a housing forming an accommodation space and a grip for a user to hold;

a baseplate assembly comprising a baseplate;

an output shaft driving the baseplate assembly to rotate about a first axis;

an electric motor driving the output shaft to rotate and comprising an electric motor shaft extending along a second axis; and a battery pack coupling portion for connecting a battery pack that is inserted along a direction parallel to the baseplate, wherein a distance between the first axis and a first surface of the battery pack coupling portion that is in contact with the battery pack is greater than or equal to 43 mm and less than or equal to 49 mm, and wherein a first included angle formed between the first axis and the second axis is greater than or equal to 10 degrees and less than or equal to 15 degrees, and a distance between the baseplate of the sander and a top of the housing is less than or equal to 120 mm.

2. The sander according to claim 1, wherein a retracted portion which gradually retracts is below the grip, and the electric motor is at least partially disposed above the retracted portion.

3. The sander according to claim 1, wherein the output shaft is supported by a first bearing and a second bearing, and a bushing is disposed between the first bearing and the second bearing.

4. The sander according to claim 1, wherein the electric motor and the output shaft are connected by a transmission shaft, and the transmission shaft has a bendable, flexible portion.

5. The sander according to claim 1, wherein when the battery pack is mounted to the sander, a distance between a top of the battery pack and a top of the housing is a first distance, and the first distance is less than or equal to 25 mm.

6. The sander according to claim 1, wherein, when the battery pack coupling portion of the sander mates with the battery pack, a projection of a center of gravity of the battery pack on a rear surface of the battery pack is in a first position, when the sander is not connected to the battery pack, a projection of a center of gravity of the sander on the rear surface of the battery pack is in a second position, a first plane passing through the second axis is defined, the first plane is substantially perpendicular to the rear surface of the battery pack, and the first position and the second position are located on two sides of the first plane separately.

7. The sander according to claim 1, comprising a bearing support made of a metallic material.

8. The sander according to claim 7, comprising a dust collection tube and a dust collection cover, wherein dust moves in the dust collection cover to the dust collection tube, the dust collection tube is used for connecting a dust collection bag, and the bearing support, the dust collection cover, and the dust collection tube are integrally formed.

9. The sander according to claim 1, comprising a maximum speed key, wherein the maximum speed key is operated so that a rotational speed of the baseplate assembly is adjusted directly to a maximum rotational speed.

10. A sander, comprising:

a housing forming an accommodation space and a grip for a user to hold;

a baseplate assembly comprising a baseplate;

an output shaft driving the baseplate assembly to rotate about a first axis;

an electric motor driving the output shaft to rotate and comprising an electric motor shaft extending along a second axis;

a transmission shaft connecting the electric motor shaft to the output shaft, wherein the transmission shaft has a bendable, flexible portion; and a battery pack coupling portion for connecting a battery pack that is inserted along a direction parallel to the baseplate, wherein a distance between the first axis and a first surface of the battery pack coupling portion that is in contact with the battery pack is greater than or equal to 43 mm and less than or equal to 49 mm, and wherein when the battery pack is mounted to the sander, a distance between a top of the battery pack and a top of the housing is a first distance, and the first distance is less than or equal to 25 mm.

11. The sander according to claim 10, wherein the transmission shaft transmits a rotational speed and torque outputted from the electric motor shaft to the output shaft.

12. The sander according to claim 10, wherein a first end of the transmission shaft and the electric motor shaft rotate together through a first conversion member, and a second end of the transmission shaft and the output shaft rotate together through a second conversion member.

13. The sander according to claim 10, wherein the transmission shaft is made of an iron-carbon alloy having a carbon content greater than or equal to 0.65% and less than or equal to 0.75%, wherein the carbon content refers to a mass fraction of carbon in the iron-carbon alloy.

14. The sander according to claim 10, wherein hardness of the transmission shaft is greater than or equal to 35 HRC and less than or equal to 40 HRC, wherein a hardness unit HRC is Rockwell hardness.

* * * * *